US009783383B2

(12) United States Patent
Kaneda

(10) Patent No.: US 9,783,383 B2
(45) Date of Patent: Oct. 10, 2017

(54) IMAGE FORMING APPARATUS AND CONTROL METHOD FOR THE SAME

(71) Applicant: CANON KABUSHIKI KAISHA, Tokyo (JP)

(72) Inventor: Takeshi Kaneda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 167 days.

(21) Appl. No.: 14/135,681

(22) Filed: Dec. 20, 2013

(65) Prior Publication Data

US 2014/0110897 A1 Apr. 24, 2014

Related U.S. Application Data

(62) Division of application No. 13/447,533, filed on Apr. 16, 2012, now abandoned.

(30) Foreign Application Priority Data

Apr. 15, 2011 (JP) ..... 2011-091471

(51) Int. Cl.
*B65H 3/44* (2006.01)
*B65H 7/20* (2006.01)
(Continued)

(52) U.S. Cl.
CPC ..... *B65H 7/20* (2013.01); *B65H 1/04* (2013.01); *B65H 3/44* (2013.01); *B65H 31/24* (2013.01);
(Continued)

(58) Field of Classification Search
CPC .... B65H 33/04; B65H 2405/332; B65H 1/04; B65H 3/44; B65H 31/24; B65H 39/10; B65H 2701/11132
(Continued)

(56) References Cited

U.S. PATENT DOCUMENTS 4,995,601 A 2/1991 Ohashi et al.
7,603,072 B2 10/2009 Yokobori et al.
(Continued)

FOREIGN PATENT DOCUMENTS

CN 1036462 A 10/1989
JP 9-114328 A 5/1997
(Continued)

OTHER PUBLICATIONS

Japanese Office Action cited in Japanese counterpart application No. JP2011-091471, dated Jan. 23, 2015.
Office Action issued in Chinese Patent Application No. 201210111204, dated Sep. 3, 2014. English translation provided.

*Primary Examiner* — Thomas Morrison
(74) *Attorney, Agent, or Firm* — Rossi, Kimms & McDowell LLP

(57) ABSTRACT

An image forming apparatus is provided. Sheets, a plurality of which form a set, are contained in each of containers, and sheets are fed from the corresponding containers. If a first sheet to be fed is in the same layer as a second sheet that was fed from the containers last time, the first sheet is fed from a set that included the second sheet in the containers is fed. If the layer of the first sheet is higher than the layer of the second sheet that was fed from the containers last time, all remaining sheets in the set that included the second sheet are discharged from the containers.

7 Claims, 13 Drawing Sheets

(51) Int. Cl.

| | |
|---|---|
| ***B65H 33/04*** | (2006.01) |
| ***B65H 39/10*** | (2006.01) |
| ***B65H 1/04*** | (2006.01) |
| ***B65H 31/24*** | (2006.01) |

(52) U.S. Cl.
CPC ..... *B65H 33/04* (2013.01); *B65H 39/10* (2013.01); *B65H 2701/11132* (2013.01); *B65H 2801/06* (2013.01)

(58) Field of Classification Search
USPC ..... 270/28.23, 58.31, 58.32; 271/9.01, 9.02, 271/9.04, 9.05, 9.12; 399/382
See application file for complete search history.

(56) References Cited

U.S. PATENT DOCUMENTS

| | | | | |
|---|---|---|---|---|
| 7,651,081 | B2 * | 1/2010 | Yokobori et al. | 270/58.23 |
| 8,100,392 | B2 | 1/2012 | Shinchi et al. | |
| 8,737,902 | B2 * | 5/2014 | Igarashi | 399/382 |
| 2008/0199200 | A1 | 8/2008 | Nakagawa et al. | |
| 2009/0311021 | A1 | 12/2009 | Kiwada | |
| 2012/0261875 | A1 | 10/2012 | Kaneda | |

FOREIGN PATENT DOCUMENTS

| | | | |
|---|---|---|---|
| JP | 2006-248672 | A | 9/2006 |
| JP | 2006256138 | A | 9/2006 |
| JP | 2007191275 | A | 8/2007 |

* cited by examiner

FIG. 9A

| CST | SIZE | TYPE | Num |
|---|---|---|---|
| CST1 | A4 | INDEX SHEET 1 | 5 |
| CST2 | A4 | INDEX SHEET 2 | 5 |
| CST3 | A4 | PLAIN PAPER | – |
| CST4 | – | – | – |
| MULTI | – | – | – |

FIG. 9B

| CST | SIZE | TYPE | Lv | Num | Cnt | Flag | Time |
|---|---|---|---|---|---|---|---|
| – | – | – | – | – | – | – | – |
| – | – | – | – | – | – | – | – |
| | | | | | | | |
| – | – | – | – | – | – | – | – |
| – | – | – | – | – | – | – | – |

FIG. 9C

| CST | SIZE | TYPE | Lv | Num | Cnt | Flag | Time |
|---|---|---|---|---|---|---|---|
| CST1 | A4 | INDEX SHEET 1 | 1 | 5 | 1 | F | 001 |
| CST2 | A4 | INDEX SHEET 2 | 2 | 5 | 2 | F | 006 |
| – | – | – | – | – | – | – | – |

FIG. 9D

| CST | SIZE | TYPE | Lv | Num | Cnt | Flag | Time |
|---|---|---|---|---|---|---|---|
| CST1 | A4 | INDEX SHEET 1 | 1 | 5 | 1 | F | 001 |
| CST2 | A4 | INDEX SHEET 2 | 2 | 5 | 2 | T | 006 |
| – | – | – | – | – | – | – | – |

FIG. 9E

| CST | SIZE | TYPE | Lv | Num | Cnt | Flag | Time |
|---|---|---|---|---|---|---|---|
| CST1 | A4 | INDEX SHEET 1 | 1 | 5 | 2 | F | 010 |
| CST2 | A4 | INDEX SHEET 2 | 2 | 5 | 0 | F | 006 |
| – | – | – | – | – | – | – | – |

FIG. 12A

| CST | SIZE | TYPE | Num |
|---|---|---|---|
| CST1 | A4 | INDEX SHEET 1 | 5 |
| CST2 | A4 | INDEX SHEET 2 | 5 |
| CST3 | A4 | PLAIN PAPER | – |
| CST4 | – | – | – |
| MULTI | – | – | – |

FIG. 12B

| CST | SIZE | TYPE | Lv | Num | Cnt | Time |
|---|---|---|---|---|---|---|
| – | – | – | – | – | – | – |
| – | – | – | – | – | – | – |
| | | | | | | |
| – | – | – | – | – | – | – |
| – | – | – | – | – | – | – |

FIG. 12C

| CST | SIZE | TYPE | Lv | Num | Cnt | Time |
|---|---|---|---|---|---|---|
| CST1 | A4 | INDEX SHEET 1 | 1 | 5 | 1 | 001 |
| CST2 | A4 | INDEX SHEET 2 | 2 | 5 | 2 | 006 |
| – | – | – | – | – | – | – |

FIG. 12D

| CST | SIZE | TYPE | Lv | Num | Cnt | Time |
|---|---|---|---|---|---|---|
| CST1 | A4 | INDEX SHEET 1 | 1 | 5 | 1 | 001 |
| CST2 | A4 | INDEX SHEET 2 | 2 | 5 | 2 | 006 |
| – | – | – | – | – | – | – |

IMAGE FORMING APPARATUS AND CONTROL METHOD FOR THE SAME

BACKGROUND OF THE INVENTION

Field of the Invention

The present invention relates to a technique for inserting sheets, a plurality of which form a set.

Description of the Related Art

Conventionally there are printing apparatuses to which multiple types of index sheets can be inserted to print pieces. For example, in the technique disclosed in Japanese Patent Laid-Open No. 2006-248672, different two types of index sheets are stored in trays A and B respectively and the printing apparatus inserts the index sheets in the tray A and the index sheets in the tray B to each of copies. The printing apparatus, when not using all index sheets included in a set, discharges the remaining index sheets from the trays A and B at the point of finishing outputting each of the copies.

Although in Japanese Patent Laid-Open 2006-248672 the two different types of index sheets are used those index sheets cannot be used in a hierarchical manner. Especially, when not all index sheets included in a set are used i.e., if some index sheets are left unused), the multiple types of the index sheets cannot be used in a hierarchical manner.

For example, it is assumed that a first type of index sheet is a higher layer (e.g., for separating chapters) and a second type of index sheet is a lower layer (e.g., for separating sections), and one set of the second-type index sheet includes N sheets. After the first sheet of the first-type index sheet is output, the first to Mth sheets of the second-type index sheets are output (M<N) (e.g. a single chapter contains M sections). In this case, (N−M) sheets of the second-type index sheet are left on the tray. Accordingly, when the second chapter of the document begins next, it is impossible to output a second sheet of the first-type index sheets and then output the second-type index sheets inserted from the beginning of the sections of the second chapter.

SUMMARY OF THE INVENTION

The present invention is to solve the foregoing problem in the conventional technique.

A feature of the present invention lies in that when two types of sheets, a plurality of which form a set, are hierarchically used, remaining unused sheets in a set are appropriately discharged.

According to one aspect of the present invention, a control apparatus comprises a first container unit for containing sheets, a plurality of which form a set, a second container unit for containing sheets, a plurality of which form a set, feed control unit for performing control to feed a sheet from a first set in the first container unit, then a sheet from a first set in the second container unit, again a sheet from the first set in the first container unit, and then a sheet from a second set in the second container unit, and a discharge control unit for performing control to discharge all remaining sheets in the first set in the second container unit after the sheet is fed from the first set in the second container unit and before the sheet is fed again from the first set in the first container unit.

According to the present invention, when two types of sheets, a plurality of which form a set, are hierarchically used, remaining unused sheets are appropriately discharged.

Further features of the present invention will become apparent from the following description of exemplary embodiments (with reference to the attached drawings).

BRIEF DESCRIPTION OF THE DRAWINGS

FIGS. 9A to 9E are tables used in processing according to the first embodiment.

FIGS. 12A to 12D are tables used in processing according to the second embodiment.

DESCRIPTION OF THE EMBODIMENTS

Figure 1:
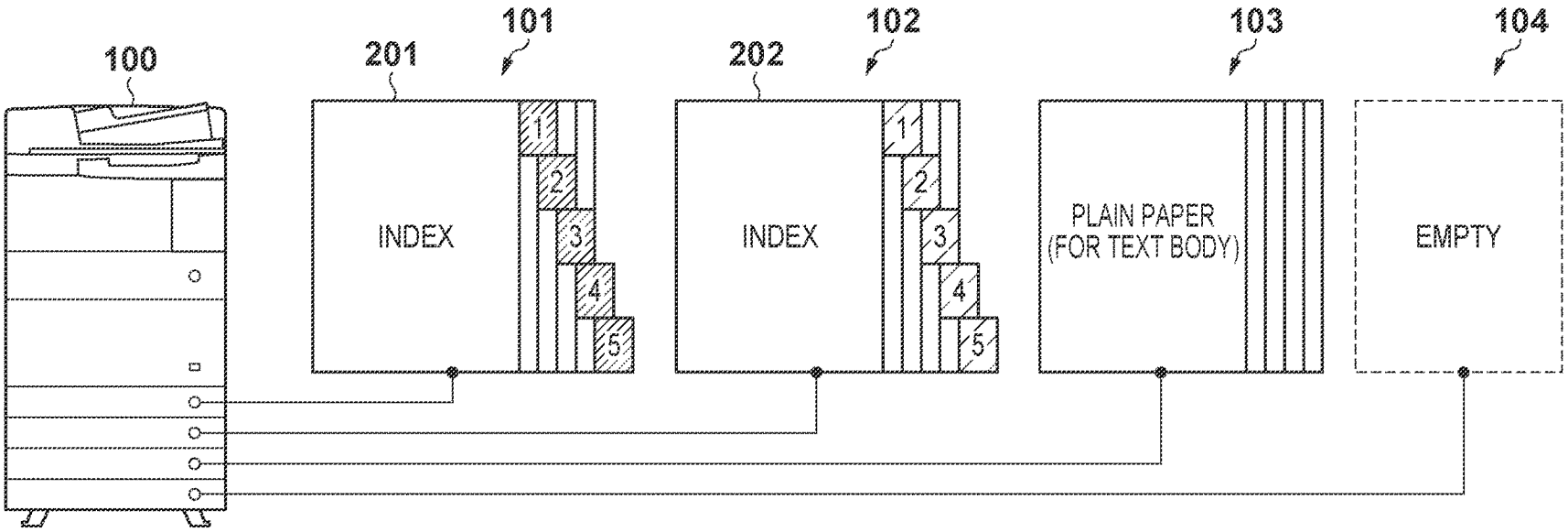
FIG. 1 is a diagram depicting a configuration and settings of a sheet feeding tray in an image forming apparatus according to embodiments of the present invention.

Various exemplary embodiments, features, and aspects of the invention will be described in detail below with reference to the drawings.

Embodiments of the present invention will be hereinafter described in detail with reference to the accompanying drawings. However, the following embodiments do not limit the scope of claims for the present invention, and not all combinations of features described in those embodiments are essential for means for solving the problem in the present invention.

In general, index sheets (specific sheets) are inserted for the purpose of separating text bodies of a document at position of captions for chapters or sections, and a "caption" for the separated text body is printed on a tub tab of each index sheet. Here, index sheets of multiple types with different tub tab positions are bundled and provided as a set, and the first piece of the index sheet with a tub tab at the highest position is fed at the start of a print job. Therefore, if the number of the index sheets inserted to print pieces in a print job is different from the number of the index sheets contained in each set of the index sheet prepared in the image forming apparatus, some of the index sheets in a set are left unused at the end of the print job. Accordingly, in that case, it is necessary to discharge those remaining index sheets outside the image forming apparatus and arrange a new complete set of the index sheets for a next printing job.

If only one type of index sheet is used for a print job, remaining index sheets are discharged when no print job exists. However, if multiple-layer index sheets in a parent-child relationship are used, the index sheets that are left unused after an immediately previous printing job have to be discharged. It is desired to achieve such control without placing a burden on an operator of an information processing apparatus or an image forming apparatus.

Accordingly, the embodiments of the present invention propose two discharge methods that can be implemented so as to suit features of a print engine in an image forming apparatus.

In a first embodiment, discharge control performed by the print engine in the image forming apparatus that changes a fixing temperature or a paper delivery speed of the print engine based on a print media (including index sheets) is described. In this type of image forming apparatus, a fixing temperature is changed when the print media is changed, and thus printing performance is lowered. Therefore, in the case where multiple layer index sheets of different sheet types are inserted, sheets to be used in a job need to be frequently switched and thus it takes longer time to output a final product unless the timing of discharging remaining index sheets outside the image forming apparatus is adjusted. To solve this problem, according to the first embodiment, the timing of discharging remaining multiple-layer index sheets is controlled to reduce the number of times of switching sheet types, thereby reducing the time taken to output a final product.

FIG. 1 is a diagram depicting a configuration and settings of a sheet feeding tray in the image forming apparatus according to the embodiments of the present invention.

This image forming apparatus 100 is a printing apparatus such as a multifunction printer (MFP) and has four sheet feeding trays. The sheet feeding trays are provided with four sheet cassettes 101 to 104 respectively. The sheet cassettes 101 and 102 contain a plurality of sets of index sheets 201 and 202, respectively, each set containing five (or a plurality of) sheets form a set respectively. The index sheet 201 and the index sheet 202 are different in sheet type. The sheet cassette 103 contains plain paper sheets on which text body of a document is printed. The sheet cassette 104 is empty.

Figure 2B:
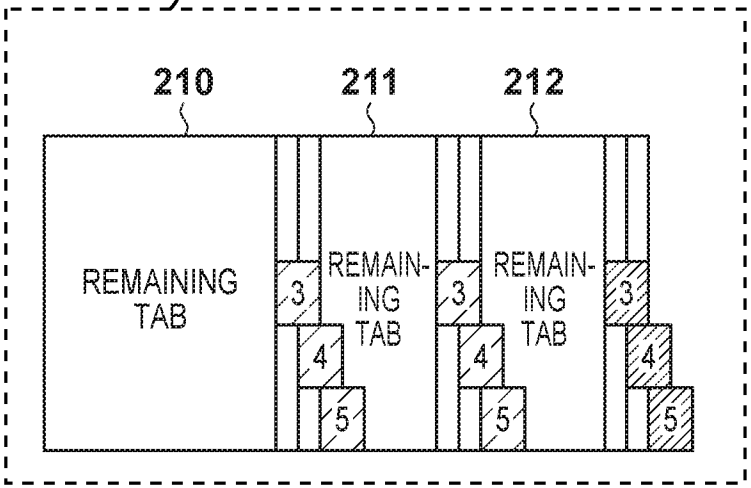
FIG. 2B is a diagram showing an example of discharge of remaining index sheets.
Figure 2A:
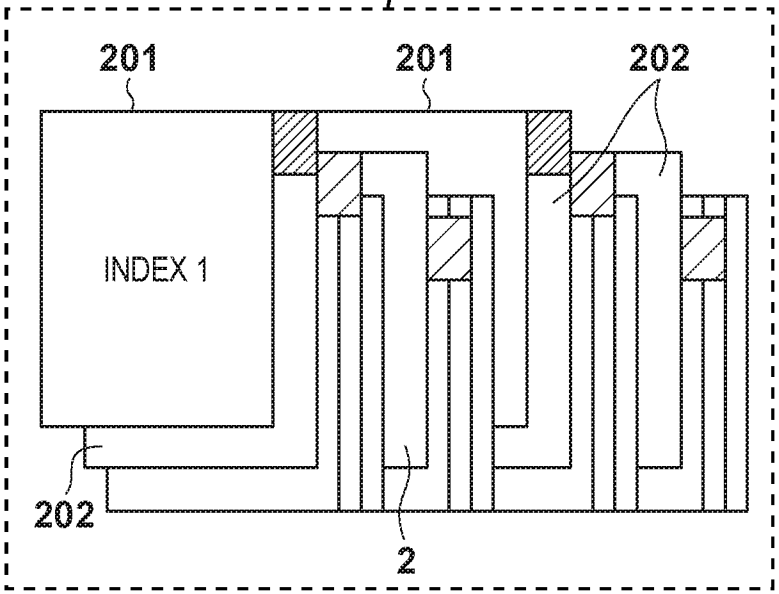
FIG. 2A is a diagram showing an example of output of a final product according to the embodiments.

FIG. 2A is a diagram showing an example of final product output, and FIG. 2B is a diagram showing an example of index sheet discharge.

In the example of final product output in FIG. 2A, the text body is divided into two chapters by the first-type index sheet 201, and each chapter is divided into two sections by the second-type index sheet 202.

The image forming apparatus 100, when receiving an order to feed a second index sheet 201 (chapter 2), determines that the first chapter contains only two sections and does not contain three to five sections and so third to fifth index sheet 202 in the first set thereof in the sheet cassette 102 are unnecessary, and discharges the third to fifth index sheets 202 in the first set thereof from the sheet cassette 102. (reference numeral 210 in FIG. 2B). After that, it is assumed that sheets are fed to section 2 of chapter 2, and the text body ends when three sheets for the text body are fed (text body of chapter 2, section 2). Then the image forming apparatus 100 determines that the index sheet 202 for sections three to five in chapter 2 (third to fifth index sheets 202, reference numeral 211 in FIG. 2B) and index sheet 201 for chapters 3 to 5 (third to fifth index sheets 201, reference numeral 212 in FIG. 2B) are unnecessary. FIG. 2B shows the remaining index sheets to be discharged. In FIG. 2B, the third to fifth index sheets 202 in the first and second sets thereof and the third to fifth index sheets 201 in the first set thereof are discharged outside the image forming apparatus 100. "To feed" or "to insert" an index sheet means outputting an index sheet to the same output destination as that of print pieces (text body), and "to discharge" an index sheet means outputting an index sheet to an output destination other than that of the print pieces. The image forming apparatus 100 has two paper discharge trays 105A, 105B, and the final product shown in FIG. 2A and the remaining index sheets shown in FIG. 2B are output to different paper discharge trays.

The embodiments are hereinafter described in detail with reference to specific examples.

Figure 3:
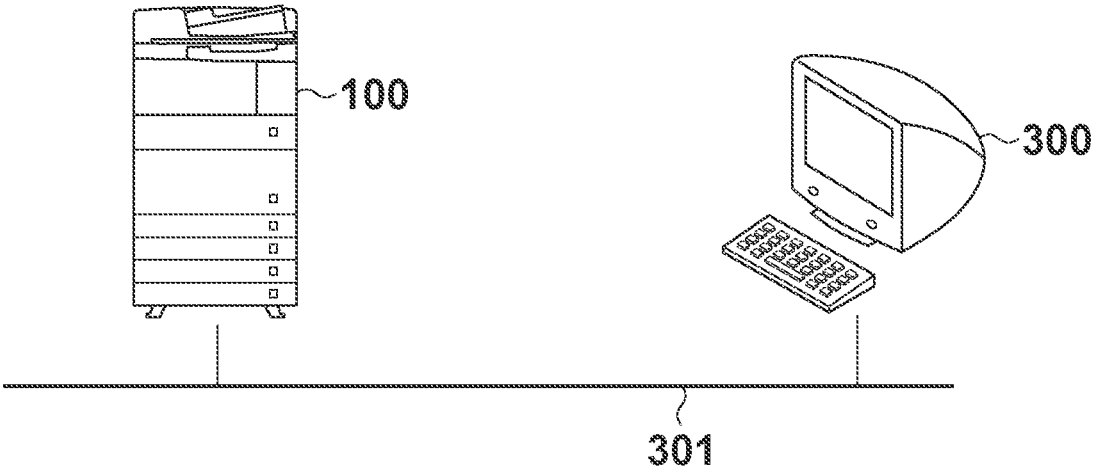
FIG. 3 is a diagram showing a configuration of a printing system according to the embodiments.

FIG. 3 is a configuration diagram of the printing system according to the embodiments of the present invention.

Here an information processing apparatus 300, such as a PC, is connected to the image forming apparatus 100 via a network 301. The information processing apparatus 300 prepares print data about a sheet size for editing and outputting print data, sheet type, insertion process for the sheet feeding trays and the index sheets, converts: the print data into PDL data for PostScript(PS)ϕ or PCL® and end the thus converted print data to the image forming apparatus 100. The image forming apparatus 100 receives the print data from the information processing apparatus 300 and performs designated processes such as image formation for each print page and index sheet insertion.

Figure 4:
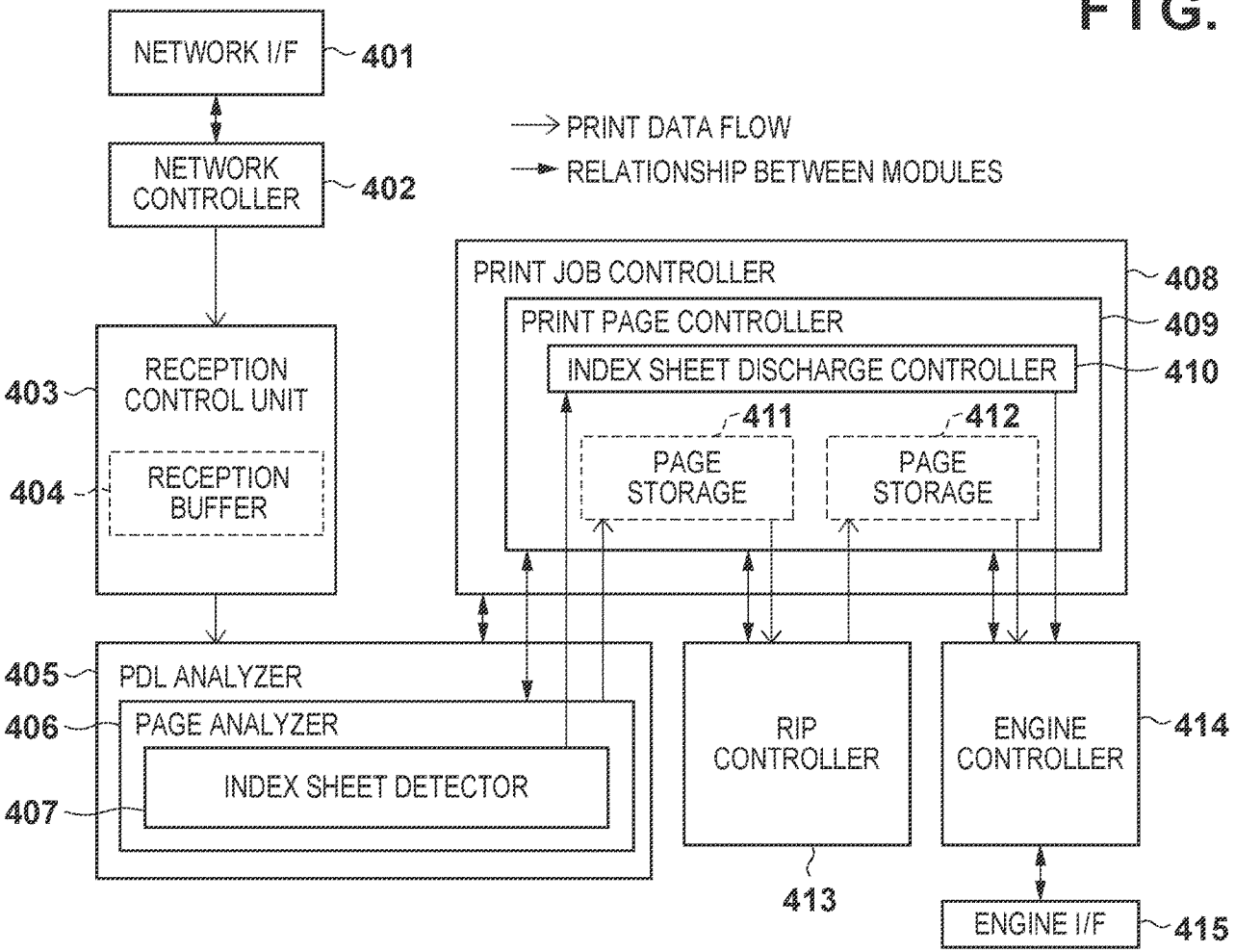
FIG. 4 is a block diagram showing a functional configuration of the image forming apparatus according to the embodiments.

FIG. 4 is a diagram showing a functional configuration of the image forming apparatus 100 according to the embodiments.

A network I/F (interface) 401 provides a TCP/IP socket I/F to a network controller 402. An application for generating PDL data in the information processing apparatus 300 sends the PS or PCL data according to the RAW or LPR data transmission protocol.

Figure 5:
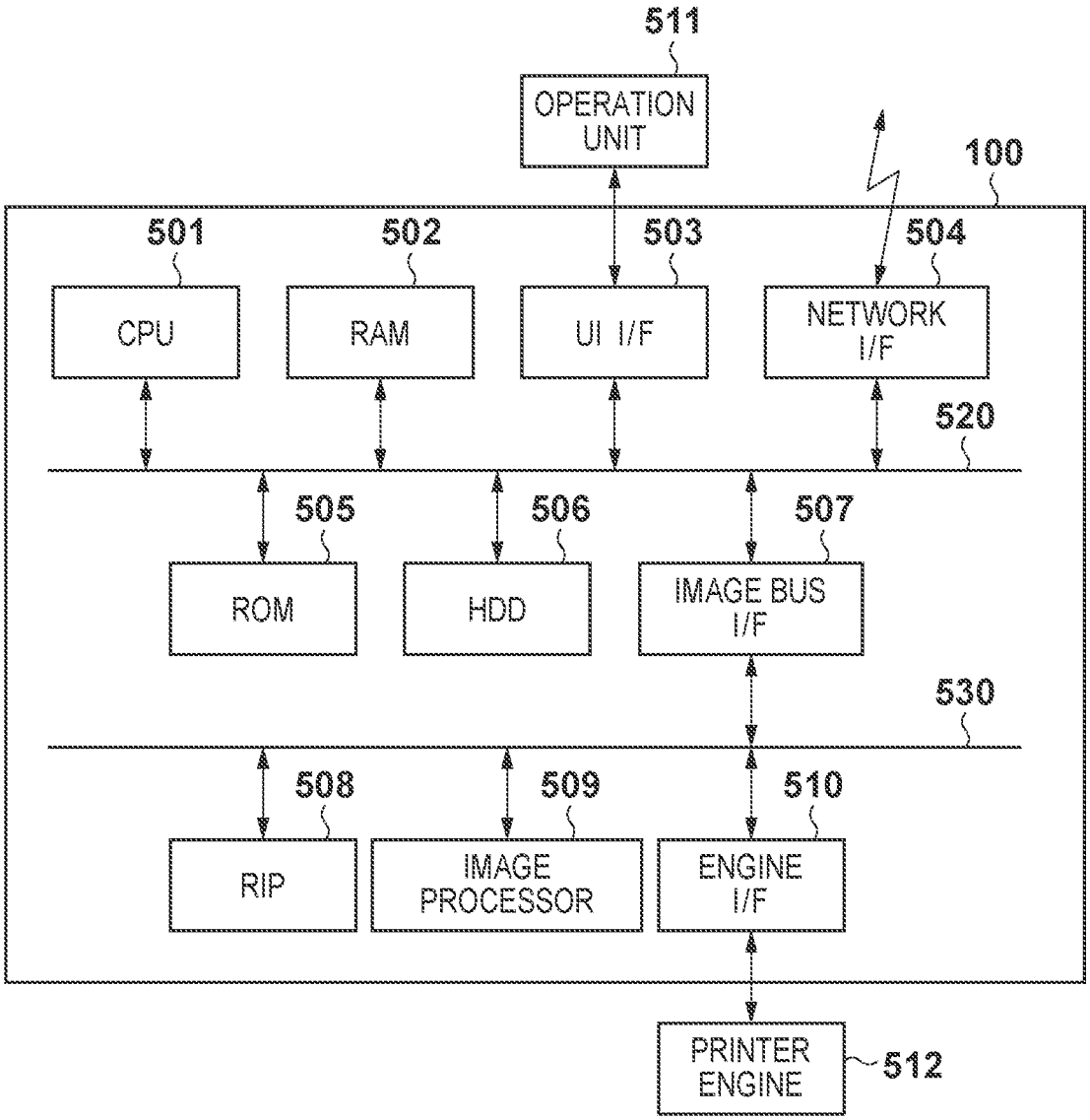
FIG. 5 is a block diagram showing a hardware configuration of the image forming apparatus according to the embodiments.

After the network controller 402 receives the PS or PCL data according to the RAW or LPR communication protocol, the image forming apparatus 100 sequentially stores the data as stream data in a HDD 506 (FIG. 5). When the network controller 402 receives print data, a print job controller 408 recognizes the commencement of print job reception and starts to process the job. Then the print job controller 408 actuates a PSI analyzer 405 and orders the PDL analyzer 405 to read the PS/PCL data stored in the HDD 506. The PDL analyzer 405 applies the PS/PCL data read from the HOD 506. A page analyzer 406 acquires, from the input data, finishing information such as a sheet size, sheet type, and designated sheet feeding tray, and performs rendering command analysis and rendering processing for each page. The rendering data is temporarily stored in a page storage 411. If an index sheet is designated as the sheet type for the print data, the page analyzer 406 sequentially notifies the index sheet discharge controller 410 of specific information on the index sheet detected by an index sheet detector 407.

Meanwhile, page data stored in the page storage 411 is subjected to raster image processing by a RIP (raster image processor) controller 413 and stored as an image optimized for a printer engine 512 (FIG. 5) in a page storage 412. Regarding the page data stored in the page storage 412, the print job controller 408 and a print page controller 409 determine in conjunction with each other the page to send to an engine controller 414. For example, in the case of bookbinding printing, pages are not sent in sequence but in an order determined in consideration of bookbinding imposition. At this time, if the index sheet is designated in the job, the index sheet discharge controller 410 verifies insert positions for the types and layers of index sheets for the job, and adjusts the timing of ordering the engine controller 414 to discharge index sheets left unused outside the image forming apparatus 100. The engine controller 414 controls the printer engine 512 via an engine I/F 415 and executes image formation processing according to an instruction from the print page controller 409.

FIG. 5 is a block diagram showing a hardware configuration of the image forming apparatus 100 according to the embodiments.

A system bus 520 is connected to a CPU 501, a RAM 502, an UI I/F 503, the network I/F 504, a ROM 505, and HDD 506, and those components communicate with each other. The components on the system bus 520 access, via an image bus I/F 507, an RIP 508, an image processor 509, and an engine I/F 510 that are connected to an image bus 530. Software shown in FIG. 4 including the print job controller 408, PDL analyzer 405, and the index sheet discharge controller 410 is executed by the CPU 501, and temporary data generated during processing is stored by the RAM 502.

The UI I/F 503 is connected to an operation unit 511 and notifies each module of a signal operated by the operation unit 511. The network I/F 504 receives, via the network 301, stream PDL data from the information processing apparatus 300 and stores the received data in the HDD 506. The ROM 505 stores various parameters and programs necessary for initiating and operating the image forming apparatus 100, and is accessed when necessary by software modules. The HDD 506 temporarily stores the PDL data received is the network, and is accessed by various modules as a data swap area for the RIP 508 and the image processor 509. The image bus I/F 507 controls data exchange between the system bus 520 and the image bus 530 in the image forming apparatus 100, and intermediates communication between the system bus 520 side where control-related software works and page image processing-related modules that work on the image bus 530. The RIP 508 connected to the image bus 530 applies a page description language (PDL) code to the image file. The image processor 509 performs resolution conversion and corrections suitable for the printer engine 512 on an image file generated by the RIP 508. The engine I/F 510 is a communication I/F for the engine controller 414 to control the printer engine 512 via the engine I/F 510.

Figure 6:
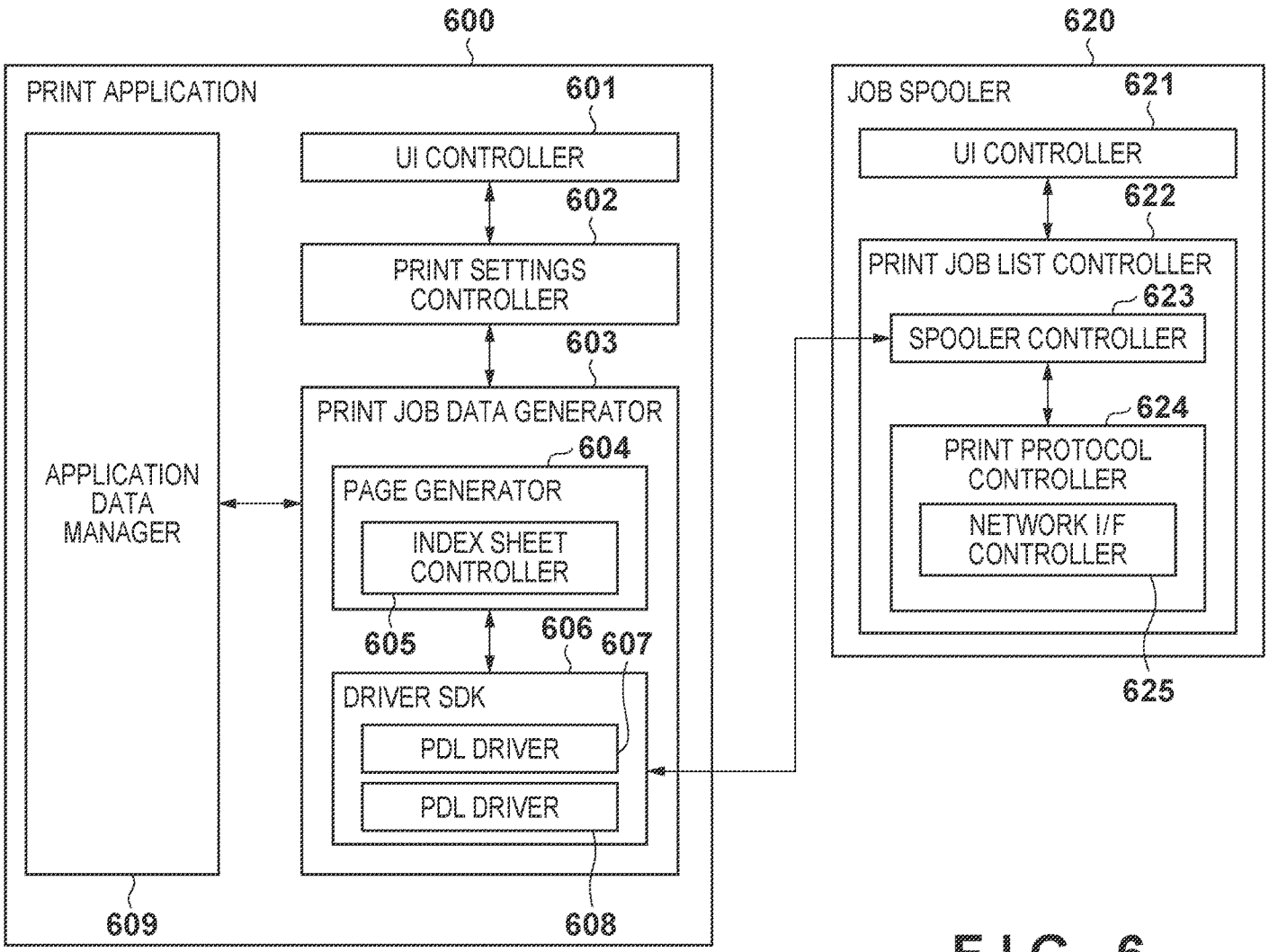
FIG. 6 is a block diagram showing a software configuration of an information processing apparatus according to the embodiments.

FIG. 6 is a block diagram showing a software configuration of the information processing apparatus 300 according to the embodiments.

The information processing apparatus 300 has two applications, or a print application 600 for specifically controlling the finish of each page of the print data and a print job spooler 620 for transferring the print data generated by the application to the image forming apparatus 100.

The print application 600 is designed for reducing a workload of an operator who configures advanced settings for printing. A user inputs specific finish settings for each page via a UI controller 601. A print settings controller 602 checks consistency regarding whether or not the print job can be implemented with the print settings ordered by the UI, and at to same time, cross-sectionally checks each of the orders such as patterning processing, adjustment parameters for color image processing, bookbinding, and index sheet insertion. If any of the orders cannot be executed, the print settings controller 602 performs conflict control such as displaying an alert. The print parameters that pass this conflict processing are stored from the print settings controller 602 to an application data manager 609.

After print start is ordered with the settings configured by the user, a print job data generator 603 reads out the print data from the application data manager 609, and a page generator 604 works with a driver SDK 606 to create print page data. The user selects a print format by selecting a driver for the image forming apparatus 100 at the time of printing. Two PDL drivers 607 and 608 are installed on the driver SDK 606. If the PDL driver 607 is selected, the page generator 604 outputs the page data according to Adobe PostScript format. If the PDL driver 608 is selected, the page generator 604 outputs the page data according to PCL format. At this time, the page generator 604 writes the sheet size and sheet type in the relevant PDL language. If an index sheet is used, the index sheet controller 605 sets a sheet feeding tray containing the index sheet to a designated sheet feeding tray, or designates the index sheet for the sheet size and sheet type information.

The job spooler 620 has an UI controller 621 and a print job list controller 622 for providing a spooler list screen. The spooler controller 623 temporarily stores the stream data generated by the driver SDK 606 and commands a print protocol controller 624 to transfer the data to the image forming apparatus 100. The print protocol controller 624 selects the RAW or LPR protocol and transfers the data via a network I/F controller 625 to the image forming apparatus 100 on the network 301.

Figure 7:
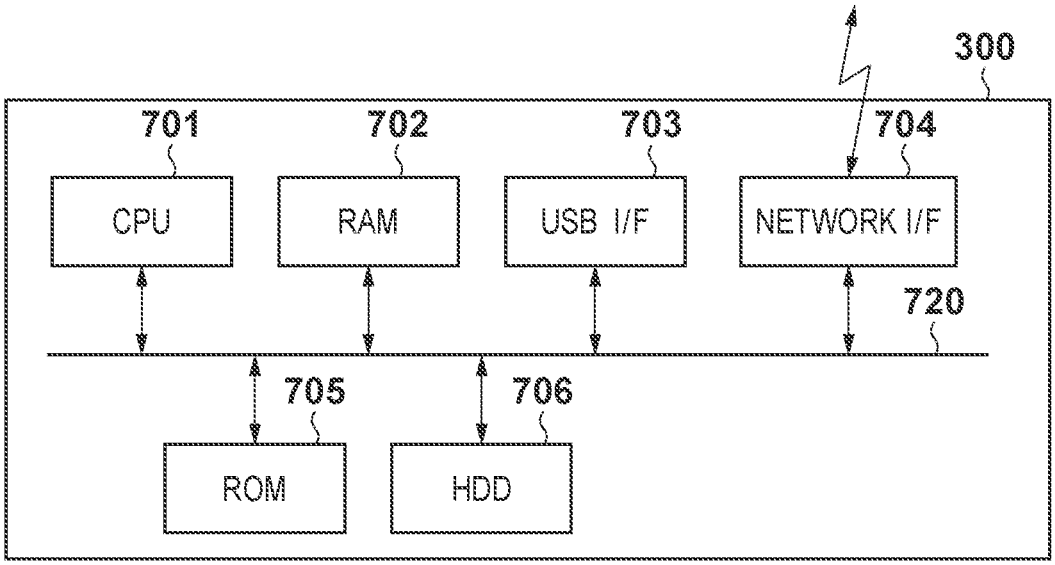
FIG. 7 is a block diagram showing a hardware configuration of the information processing apparatus according to the embodiments.

FIG. 7 is a block diagram showing a hardware configuration of the information processing apparatus 300 according to the embodiments.

A system bus 720 is connected to a CPU 701, a RAM 702, a USB I/F 703, a network I/F 704, a ROM 705, and an HDD 706, and those components communicate with each other. Software shown in FIG. 6 including the print application 600, the job spooler 620, and the index sheet controller 605 in the print application 600 is executed by the CPU 701, and temporary data generated during processing is stored in the RAM 702. The USE I/F 708 is connected to a pointing device or a keyboard or the like and notifies various modules of en input device signal. The network I/F 704 sends the stream PDL data via the network 301 to the image forming apparatus 100.

First Embodiment

Figure 8A:
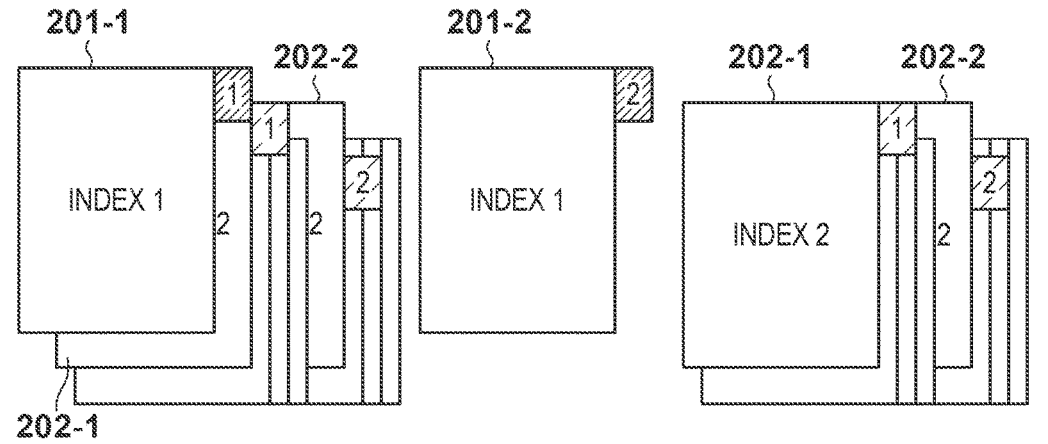
FIGS. 8A to 8C are diagrams depicting an order of insertion of index sheets and discharge of remaining index sheets according to a first embodiment.
Figure 8B:
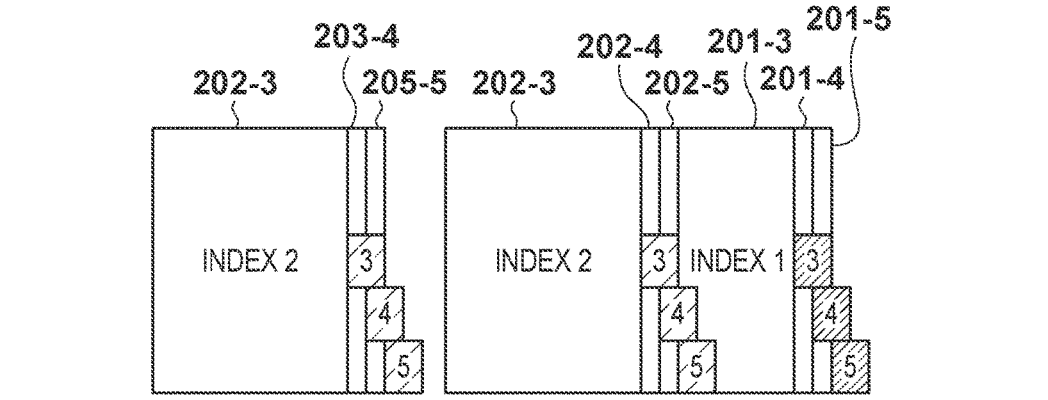
Figure 8C:
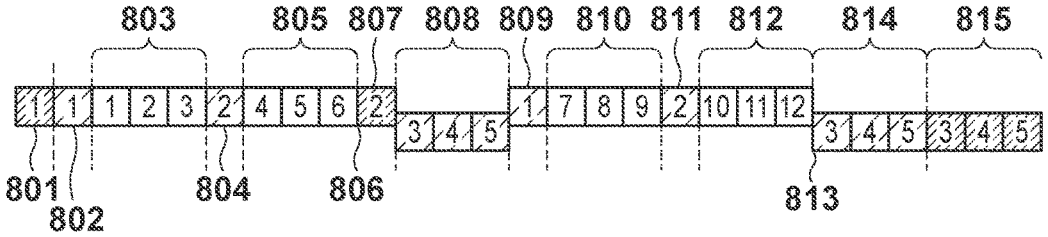

FIGS. 8A to 8C are diagrams depicting index sheet insertion and remaining index sheet discharge performed based on a process flow (FIG. 10) according to the first embodiment of the present invention. The index sheet 1 and the index sheet 2 in FIGS. 8A and 8B correspond to the index sheet 201 and the index sheet. 202 in FIG. 1, respectively. A numeral shown in each frame (corresponding to index sheets and text bodies) shown in FIG. 8C indicates the sheet number in a set of index sheets.

Referring to FIG. 8A, the index sheet 201-1 for the first chapter is first fed and inserted, and then the index sheet 202-1 for section 1 of chapter 1 is fed and inserted. Next, three consecutive pages of the text body are output, and then the index sheet 202-2 for section 2 of chapter 1 is fed and inserted. Next, three consecutive pages of the text body are output. After that, when feed of the index sheet 201-2 indicating the beginning of chapter 2 is ordered, it is recognized at this point that the index sheets 202-3 to 202-5 in the first set will be left unused (FIG. 8B).

In the first embodiment, the index sheets 202-3 to 202-5 are not immediately discharged, but the index sheet 201-2 indicating the beginning of chapter 2 is first fed and inserted, and then the index sheets 202-3 to 202-5 are discharged. Then, as shown in FIG. 8A, the index sheet 202-1 in the second set for section 1 of chapter 2 is fed and inserted, three consecutive pages of the text body are output, and the index sheet 202-2 in the second set for section 2 of chapter 2 is inserted. After that, when the end of job is ordered after three consecutive pages of the text body are output, the remaining index sheet 202-3 to 202-5 in the second set and index sheet 201-3 to 201-5 in the first set are discharged (FIG. 8B).

FIG. 8C is a diagram showing the above-described feed and discharge of the index sheet in a chronological manner.

The index sheet 201-1 indicating chapter 1 is inserted at frame 801, and the index sheet 202-1 indicating section 1 of chapter 1 is inserted at frame 802. Frames 803 represent text body print pages of section 1 of chapter. At frame 804 the second index sheet 202-2 indicating section 2 of chapter 1 is inserted. Frames 305 represent text body print pages of section 2 of chapter 1.

When insertion of the index sheet 201-2 for chapter 2 is ordered at point 806, the second index sheet 201-2 is inserted at frame 807. After that, remaining three index sheet 202-3 to 202-5 (third and fifth pieces of the index sheet 202 in the first set) are discharged at frames 808. Then, at frame 809, the index sheet 202-1 in the second set indicating section 1 of chapter 2 is inserted. Frames 810 represent text body print pages of section 1 of chapter 2. At frame 811, the index sheet 202-2 in the second set indicating section 2 of chapter 2 is inserted. Frames 812 represent text body print pages of section 2 of chapter 2. When a job end is ordered at point 813, three remaining index sheet 202-3 to 202-5 in the second set (third to fifth index sheets 202 in the second set) are discharged at frames 314. Then, at frames 815, the three remaining index sheet 201-3 to 201-5 in the first set (third to fifth index sheets 201 in the first set) are discharged.

As described above, when feed of the higher-layer (chapter) index sheet 201 is requested, the lower-layer (section) index sheets 202 that are left unused at this moment are not immediately discharged, but the second higher-layer (chapter) index sheet 201 is first fed. Then, prior to feed of the index sheet 202 in the second set, which is an index for section 1 of chapter 2, the third to fifth index sheets 202 in the first set that a left unused at the end of chapter 1 are discharged.

FIGS. 9A to 9E are diagrams depicting various tables used in the processing according to the first embodiment.

FIG. 9A shows a sheet feeding tray table that keeps sheet information set for four sheet feeding trays in the image forming apparatus 100. This table is automatically updated every time a registered sheet for each sheet feeding tray is changed. The term "CST" indicates the position of a sheet feeding tray, the term "SIZE" indicates the sheet size contained in a sheet feeding tray, and the term "TYPE" indicates the sheet category classified based on a basis weight of a sheet. A difference in the basis weight affects adjustment of a fixing temperature in the image forming apparatus 100. The term "Num" indicates the number of index sheets per set contained in the sheet feeding tray at each point. Namely, if the Num entry is "5," sets of five index sheets are contained. Here, CST1 to CST4 correspond to the sheet cassettes 101 to 104 in the our sheet feeding trays, respectively. As described in FIG. 1, sets of five index sheets 201 of size A4 are contained in the sheet cassette 101, and sets of five index sheets 202 of size A4 are contained in the sheet cassette 102. The third sheet cassette 103 contains A4 plain paper and the fourth sheet cassette 104 is empty.

FIGS. 9B to 9E show an index sheet management table held by the index sheet discharge controller 410. This table is generated when a pint job is entered and deleted at the job end. If no information on the index sheet exists in the print job, no index sheet is registered for the table. Meanwhile, if the print page controller 409 detects the index sheet, the print page controller 409 registers the index sheet for the table and manages till the job end the number of fed sheets and remaining sheets, and whether or not to discharge sheets outside the image forming apparatus 100. In FIGS. 9B to 9E, the terms "CST," "SIZE," "TYPE," and "Num" have the same meaning as in FIG. 9A and further description is omitted. The term "Lv" indicates a layer of an index sheet, and the smaller number means the higher layer of the index sheet. In the example of FIGS. 9A to 9E, CTS1 corresponds to the sheet cassette 101 in FIG. 1 and CTS2 corresponds to the sheet cassette 102 in FIG. 1. The index sheet 1 corresponds to the index sheet 201 in FIG. 1 and the index sheet 2 corresponds to the index sheet 202 in FIG. 1.

After the job is started, when the index sheet 201 ("index sheet 1") is first fed from the sheet cassette 101 ("CST1"), "index sheet 1" and "Lv=1" are registered. Next, the index sheet 202 ("index sheet 2") is fed from the sheet cassette 102 ("CST2"), then "index sheet 2" and "Lv=2" are registered. The parental relationship between CST1 and CST2 (CST1 is higher than CST2) is not changed during this job. However, once the job ends, the content of the relevant entries in the index sheet management table is cleared. Accordingly, for example, if in the next job feed of the index sheet in CST2 is ordered before feed of the index sheet in CST1 is ordered, the parental relationship is changed such that CST2 is higher than CST1. Every time a new index sheet is registered for the index sheet management table, the CST, SIZE, Num, Cnt, Flag, and Time entries for this index sheet are also registered.

The term "Num" indicates the number of the set index sheets per set, and the term "Cnt" indicates the number of sheets that have been fed so far in a set. Specifically, Num-Cnt is the number of remaining index sheets. The initial value of the Cnt entry is zero. The term "Flag" indicates whether or not a new set of the index sheets in the corresponding sheet feeding tray needs to be reset. "Flag=T (TRUE)" means that before Num-Cnt index sheets have to be discharged from this sheet feeding tray to the outside the image forming apparatus 100 before next feed of the index sheet from this sheet feeding tray. The initial value of the Flag entry is F (False). The term "Time" means a time stamp, and the time when the information on the relevant sheet feeding tray was update is stored. By searching the entire table for the latest record, the index sheet that was fed last time can be immediately found out. It is the information necessary for determining whether or not the index sheet to be fed next and the index sheet that was fed last time is the same.

FIG. 9B shows the index sheet management table before a job is entered. The table has no content at this moment.

FIG. 9C shows an index sheet management table immediately after the index sheet 202 for section 2 of chapter 1 is fed at the frame 804 in FIG. 8C. At this time, the Cnt entry for the index sheet 201 is one and the Cnt entry for the index sheet 202 is two.

FIG. 9C shows the index sheet management table when insertion of the index sheet 201 for chapter 2 is ordered at point 806 in FIG. 8C. Here, "T (=True)" is registered for the Flag entry for the index sheet 202. That is because Num-Cnt index sheets 202 have to be discharged from the sheet cassette 102 outside the image forming apparatus 100 prior to feed of the second set of the index sheets 202 from the sheet cassette 102. Other data is the same as in FIG. 9C.

FIG. 9E shows the index sheet management table after discharge of the first set of the index sheets 202 is finished at the from in FIG. 8C. Here, the Flag entry for the index sheet 702 is restored to the original "F" and the Cnt entry for the index sheet 202 is set to zero. The Cnt entry for the index sheet 201 is added and updated to "2."

Figure 10:
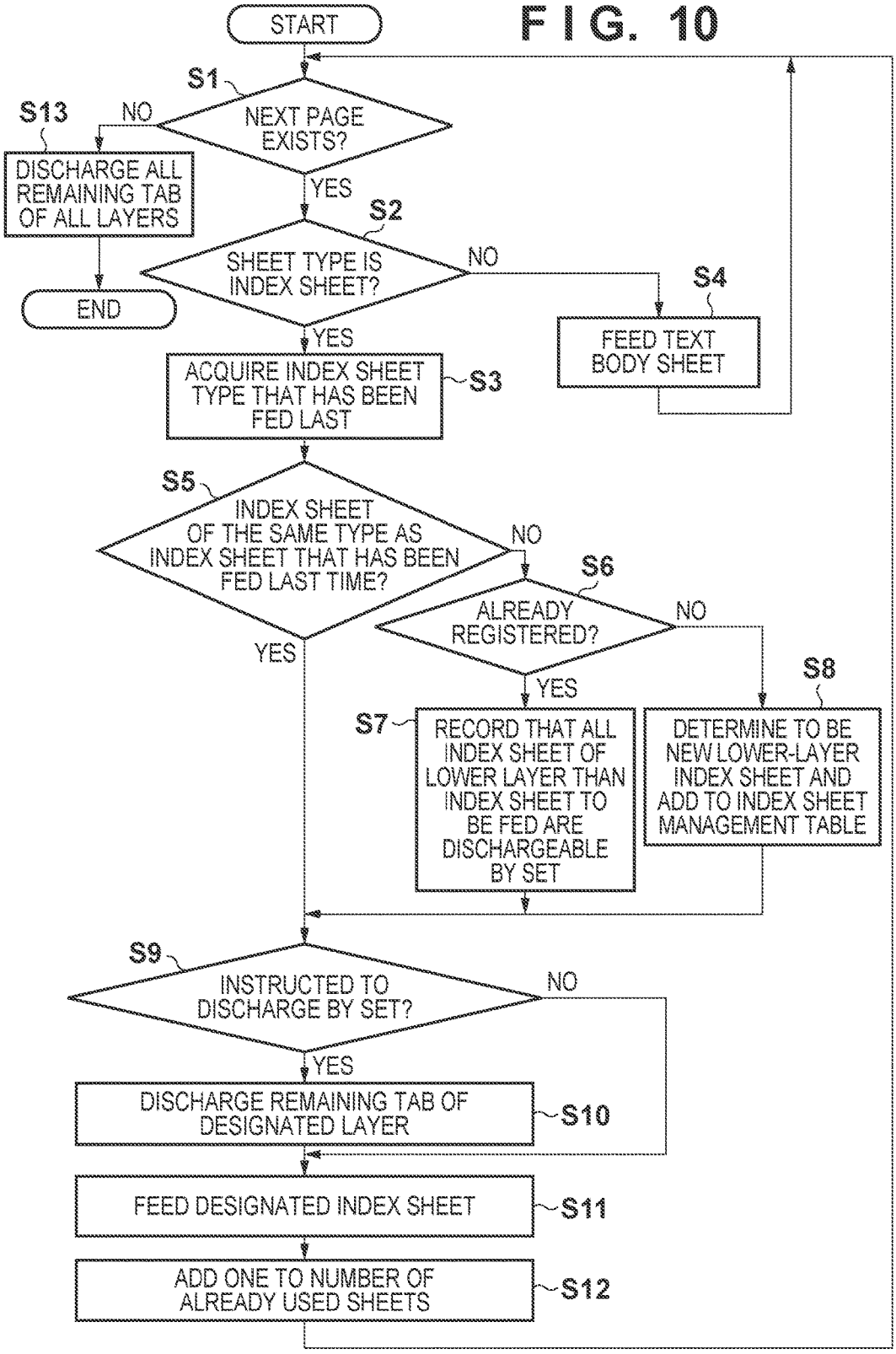
FIG. 10 is a flowchart depicting index sheet discharge control in the image forming apparatus according to the first embodiment.

FIG. 10 is a flowchart depicting the process of index sheet discharge control by the image forming apparatus 100 according to the first embodiment of the present invention. The programs for executing this process are stored in the ROM 505 and executed under the control of the CPC 501. More specifically, the process is controlled by two modules of the print page controller 409 and the index sheet discharge controller 410 in the image forming apparatus 100.

First, in S1 the print page controller 409 checks whether or not any page to be printed exists. If exists, the processing proceeds to S2 and the index sheet discharge controller 410 determines whether or not the sheet to be fed next is the index sheet based on the sheet type, sheet size, and the sheet feeding tray for the page. The process differs between type A (the case where only the sheet size and sheet type are designated) and type B (the case where only the sheet feeding tray is designated).

In the case of type A, the sheet type and sheet size are designated but the sheet feeding tray is not expressly designated. Therefore the index sheet discharge controller 410 determines whether or not the sheet to be fed next is the index sheet based on the designated sheet type, and refers to the sheet feeding tray table and selects the sheet cassette containing the sheet of the designated sheet type and sheet size. If there are two or more sheet cassettes that meet the conditions, the sheet cassettes is selected in the order of CST1>2>3>4. Meanwhile, in the case of type B, only the sheet feeding tray is designated but the sheet size and sheet type are not defined. Therefore the index sheet discharge controller 410 refers to the sheet feeding tray table and checks the sheet type and sheet size for the sheet feeding tray. Then, the index sheet discharge controller 410 determines whether or not the sheet to be fed next is the index sheet based on the checked sheet type. In any case, the processing proceeds to S3 if it is determined in S2 that the sheet to be fed next is the index sheet (first specific sheet). In S3, the index sheet discharge controller 410 searches for the above-described index sheet management table and acquires the sheet size, sheet type, and sheet feeding tray of the index sheet (second specific sheet) that was fed last time. Meanwhile, if the sheet to be fed next is not the index sheet, the processing proceeds to S4 and the print page controller 409 feeds the sheet for printing the text body.

In S5, the index sheet discharge controller 410 compares the index sheet to be fed next determined in S2 with the index sheet that was fed last time acquired in S3 and checks whether or not those two index sheets are the same. If the two index sheets are the same, the processing proceeds to S9 and the index sheet of the current layer is inserted. Meanwhile, if the two index sheets are different, the processing proceeds to S6. The processing also proceeds to S6 when the index sheet that was fed last time does not exist. In S5, the index sheet discharge controller 410 checks whether or not the index sheet determined in S2 is one registered for the index sheet management table. If the index sheet determined in S2 is already registered for the index sheet management table, the processing proceeds to S7 and the index sheet discharge controller 410 changes the Flag entry for the index sheet of the lower layer than the index sheet determined in S2 from "F" to "T." This example is shown in FIG. 9D. Meanwhile, if the index sheet determined in S2 is not registered for the index sheet management table, the processing proceeds to S8 and the index sheet discharge controller 410 adds the index sheet determined in S2 as a new index sheet to the index sheet management table.

In S9, the index sheet discharge controller 410 checks the Flag entry for the index sheet to be fed next in the index sheet management table. If Flag=T, the processing proceeds to S10 at the index sheet discharge controller 410 discharges Num-Cnt index sheets outside the image forming apparatus 100. Further, the index sheet discharge controller 410 sets the Cnt entry for the index sheet to be fed next to zero and the Flag entry to F (False). Meanwhile, if Flag=F in S9, the processing proceeds to S11 and the print page controller 409 feeds the designated index sheet (the index sheet determined in S2) (feed control). After the index sheet is fed in S11, the processing proceeds to S12 and the index sheet discharge controller 410 adds one to the Cnt entry for the index sheet fed in S11, then the processing returns to S1.

Meanwhile, if in S1 there is no page to print, the processing proceeds to S13 and the index sheet discharge controller 410 discharges outside the image forming apparatus 101 the index sheet with Num-Cnt not being zero. It should be noted that the index sheet discharge in S10 is different from the index sheet discharge in S13. S10 is a step of discharging remaining index sheets before the index sheet of the same layer as the index sheet to be discharged is fed, which is exactly the point of this embodiment.

As described above, according to the first embodiment, the timing of discharging remaining multiple-layer index sheets provided in sets is controlled and the number of times of switching the index sheets is reduced, thus the time taken to output the final product is reduced.

Second Embodiment

Next, a second embodiment of the present invention is described. The configuration and system configuration of the image forming apparatus 100 and the information processing apparatus 300 in the second embodiment is the same as the above-described first embodiment so the description thereof is omitted.

Further, the second embodiment is available when the print engine in to image forming apparatus is capable of fixing or transferring all index sheets to be fed at a fixed speed, and in that case it is not necessary to consider the deterioration in performance occurring when sheet types are switched. Accordingly, multiple-layer index sheets that are left unused can be discharged outside the image forming apparatus 100 at different (earlier) timing from the first embodiment.

Figure 11A:
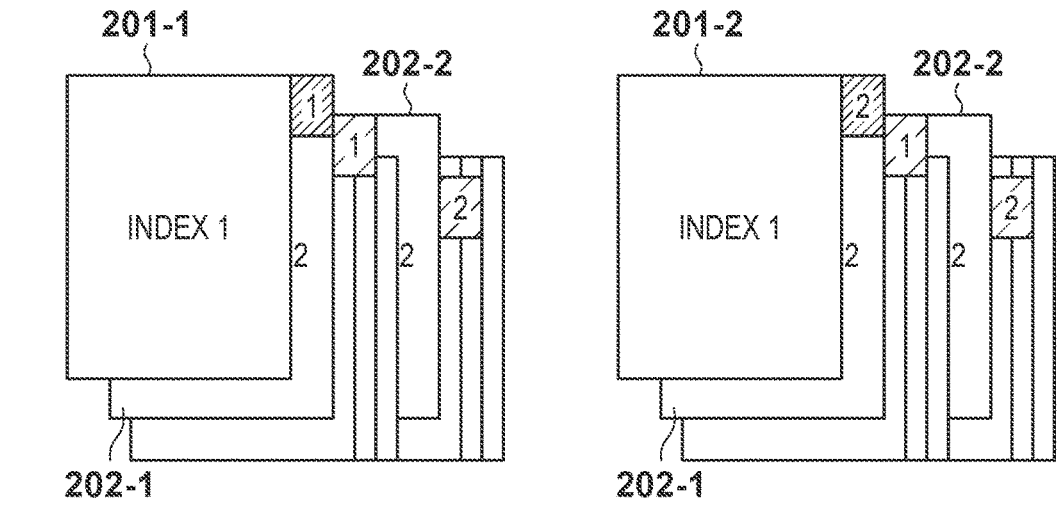
FIGS. 11A to 11C are diagrams depicting an order of insertion of index sheets and discharge of remaining index sheets according to a second embodiment.
Figure 11B:
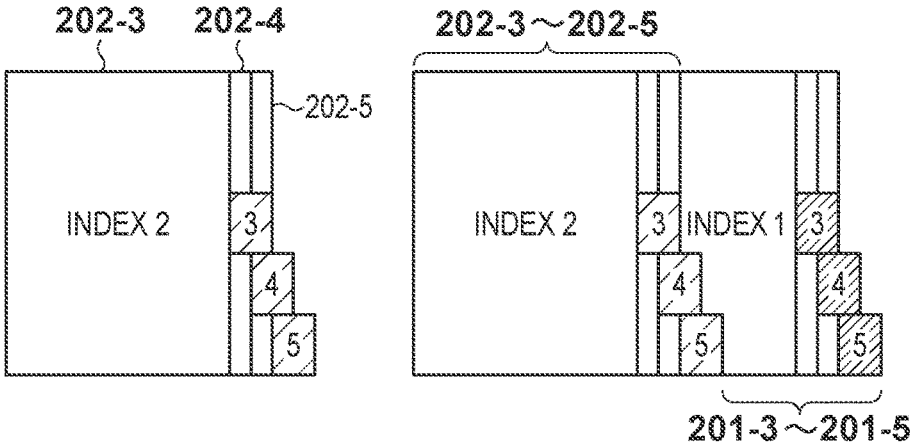
Figure 11C:
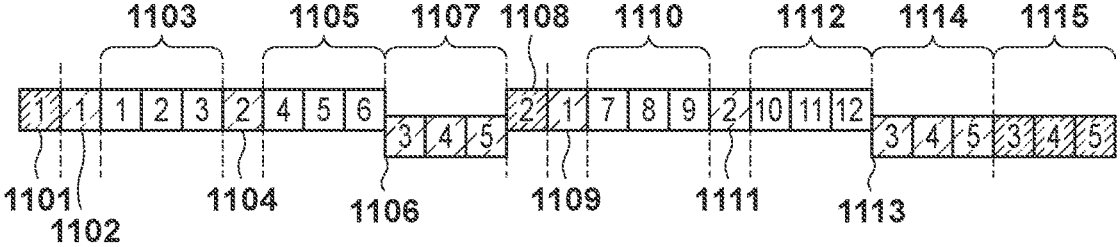

FIGS. 11A to 11C show the order of discharging final products and remaining index sheets according to a process flow (FIG. 13) in the second embodiment. In the second embodiment, when remaining index sheets are discharged outside the image forming apparatus 100, the number of times of switching the sheets is not reduced. In other words, if feed of a higher-layer (chapter) index sheet 201 is requested while a lower-layer (section) index sheet 202 is being fed, remaining index sheets 202 (third to fifth sheet) are immediately discharged outside the image forming apparatus 100 and then the higher-layer (chapter) index sheet 201 is fed.

FIGS. 11A to 11C are diagrams depicting the index sheet insertion and remaining index sheet discharge performed according to the process flow in the second embodiment. If FIGS. 11A to 11C, the index sheet 1 corresponds to the index sheet 201 (FIG. 1) and the index sheet 2 corresponds to the index sheet 202 (FIG. 1). A numeral shown in each frame in FIG. 11C indicates the sheet number in a set of index sheets.

In FIG. 11A, the image forming apparatus 100 first feeds and inserts the index sheet 201-1 for chapter 1, then the index sheet 202-1 for section 1 of chapter 1. Next, three consecutive pages of the text body are output, and the index sheet 202-2 for section 2 of chapter 1 is fed and inserted. Then three consecutive pages of the text body are output, and chapter 1 ends.

Next, when feed of the index sheet 201-2 indicating the beginning of chapter 2 is instructed, the second index sheet 201-2 is fed and inserted, and then the index sheet 202-1 for section 1 of chapter 2 is fed and inserted. After that, three consecutive pages of the text body are output, and the index sheet 202-2 for section 2 of chatter 2 is fed and inserted. Then three consecutive pages of the text body are output, and chapter 2 ends.

According to the second embodiment, as shown in FIG. 11B, remaining index sheets 202-3 to 202-5 in the first set are discharged at the end of chapter 1. Further, at the job end, remaining index sheets 202-3 to 202-5 in the second set and remaining index sheets 201-3 to 201-5 in the first set are discharged.

FIG. 11C is a diagram showing feed and discharge of the index sheet according to the second embodiment in a chronological manner.

At frame 1101, the index sheet 201-1 indicating chapter 1 is inserted, and at frame 1102 the index sheet 202-1 indicating section 1 of chapter 1 is inserted. Frames 1103 represent text body print pages (three pages) of section 1 of chapter 1. At frame 1104, the index sheet 202-2 indicating section 2 of chapter 1 is inserted. Frames 1105 represent text body print pages of section 2 of chapter 1. When at point 1106 insertion of the index sheet 201-2 for chapter 2 is ordered, at frames 1107 remaining index sheet 202-3 to 202-5 in the first set (third to fifth index sheets 202 in the first set) are discharged.

At frame 1108 the second index sheet 201-2 is inserted, and then at frame 1109 the index sheet 202-1 in the second set indicating section 1 of chapter 2 is inserted. Frames 1110 represent text body print pages of section 1 of chapter 2. At frame 1111 the index sheet 202-2 in the second set indicating section 2 of chapter 2 is inserted. Frames 1112 represent text body print pages of section 2 of chapter 2. When the job end is ordered at point 1113, remaining index sheets 207-3 to 202-5 in the second set (third to fifth index sheets 202 in the second set) are discharged at frames 1114. Further, at frame 1115 remaining index sheets 201-3 to 201-5 in the first set (third to fifth index sheets 201 in the first set) are discharged.

As described above, if feed of a higher-layer (chapter) index sheet 1 (201) is requested, lower-layer (section) index sheets 202 that are left unused at that moment are immediately discharged, and then a second piece of the higher-layer (chapter) index sheet 201 is fed and inserted.

FIGS. 12A to 12D are diagrams depicting various tables used in the processing according to the second embodiment.

FIG. 12A shows a sheet feeding tray table that holds sheet information set for four sheet feeding trays in the image forming apparatus 100. This table is automatically updated every time the registered sheet for each sheet feeding tray is changed. The terms CST, SIZE, and Num have the same meaning as in the above-described first embodiment, so the description thereof is omitted. Further, as described in FIG. 1, the sheet cassettes 101 and 102 contain the A4 index sheets 201 and 202 provided in sets of five pieces. The third sheet cassette contains A4 plain paper, and the fourth sheet cassette is empty.

FIGS. 12B to 12D show the index sheet management table held by the index sheet discharge controller 410 in the same manner as in the first embodiment. An entry of this table is generated when a print job is entered, and deleted at the end of the job. If no information on the index sheet exists in a print job, no index sheet is registered for the table. Meanwhile, if the print page controller 409 detects an index sheet, the print page controller 409 registers the index sheet for the table and manages the number of fed sheets (and remaining sheets) and whether or not to discharge outside the image forming apparatus 100 and the like.

FIG. 12B shows the index sheet management table before a job is entered. At this moment, the index sheet management table is empty.

FIG. 12C shows the index sheet management table immediately after the index sheet 202 for section 2 of chapter 1 is fed in S1104 in FIG. 11C. Here, the Cnt entry for the index sheet 201 is one, and the Cnt entry for index sheet 202 is two.

FIG. 12D shows the index sheet management table after insertion of a piece of the index sheet 201 for chapter 2 is ordered and the remaining third and fifth index sheets 202 in the first set are discharged at frame 1116 in FIG. 11C. Here, the Cnt entry for the index sheet 201 is one, and the Cnt entry for the index sheet 202 is zero.

Figure 13:
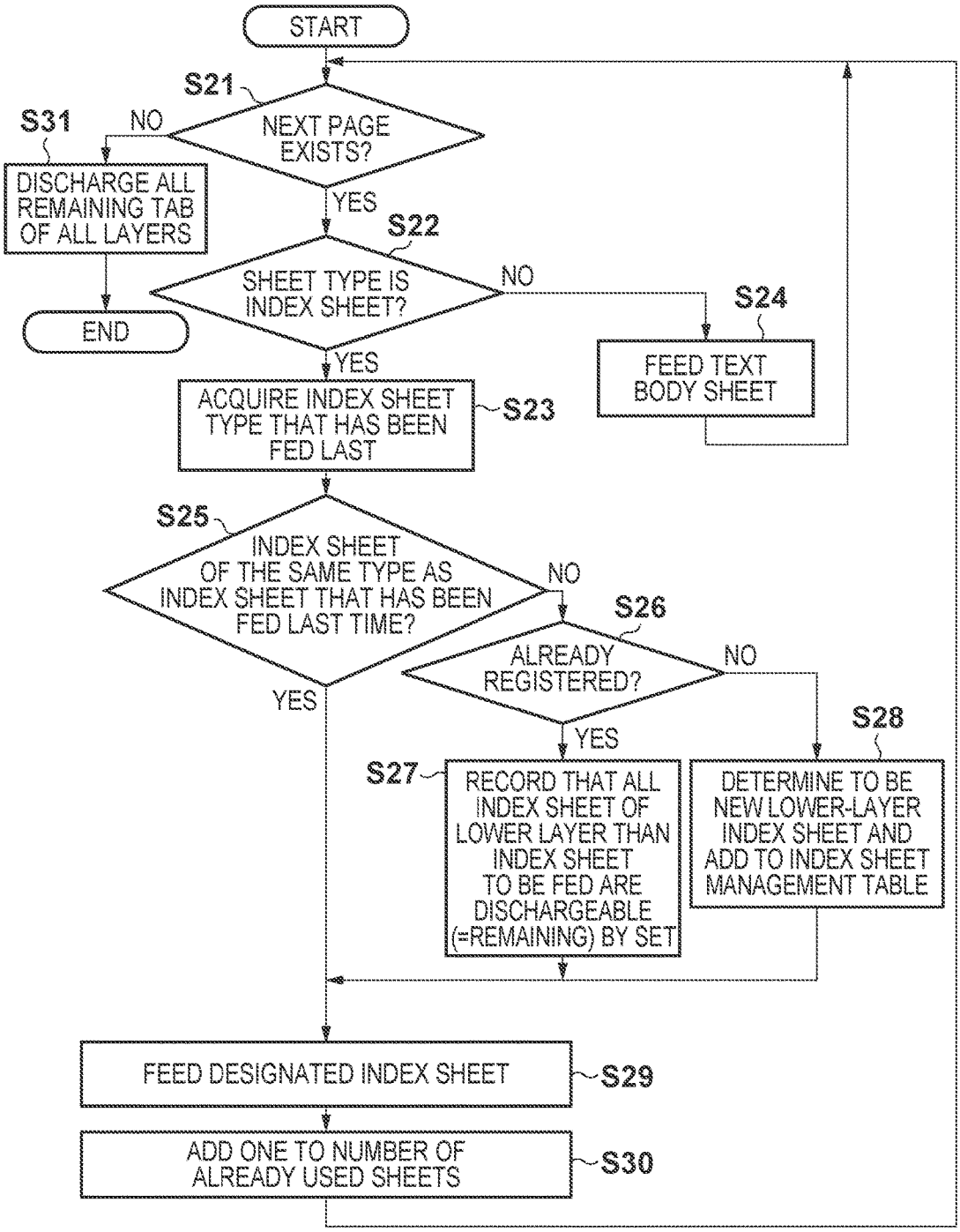
FIG. 13 is a flowchart depicting discharge control for index sheets of the image forming apparatus according to the second embodiment.

FIG. 13 is a flowchart depicting the process of index sheet discharge by the image forming apparatus 100 according to the second embodiment of the present invention. The programs for executing this process is stored in the ROM 505 and executed under the control of the CPU 501. More specifically, the process is controlled by two modules of the print page controller 409 and the index sheet discharge controller 410 in the image forming apparatus 100.

First, in S21 the print page controller 409 checks whether or not any page to print next exists. If a page to print exists, the processing proceeds to 322 and the index sheet discharge controller 410 determines whether or not the sheet to be fed next is an index sheet based on the sheet type, sheet size, and sheet feeding tray for the page. The procedure differs between type A (in the case where only the sheet size and the sheet type are designated) and type B (in the case where only the sheet feeding tray is designated).

In the case of type A, only the sheet type and sheet size are designated in the acquired information and the sheet feeding tray is not expressly designated. Therefore, the index sheet discharge controller 410 determines whether or not the sheet to be fed next is an index sheet based on the designated sheet type, and refers to the sheet feeding tray table and selects the sheet cassette that contains the sheet of the designated sheet type and sheet size. If two or more sheet cassettes meet the conditions, the sheet cassette is selected in the order of CST1>2>3>4. Meanwhile, in the case of type B, only the sheet feeding tray is designated and the sheet size, sheet type are not defined. Therefore, the index sheet discharge controller 410 refers to the sheet feeding tray table and checks the sheet type and sheet size of the sheet feeding tray. Then, the index sheet discharge controller 410 determines whether or not the sheet to be fed next is an index sheet based on the thus checked sheet type. In any case, the processing proceeds to S23 if in S22 the sheet to be fed next is determined to be an index sheet. In S23, the index sheet discharge controller 410 searches the above-described index sheet management table and acquires the sheet size, sheet type, and sheet feeding tray of the index sheet that was fed last time. If the sheet to be fed next is not an index sheet, the processing proceeds to S24 and the print page controller 409 feeds a sheet for printing text body.

In S25, the index sheet discharge controller 410 compares the index sheet to be fed next determined in S22 with the index sheet that was fed last time acquired in S23 and checks whether or not those two index sheets are the same. If the two index sheet are the same, the processing proceeds to S29 and the index sheet of the current layer is inserted. Meanwhile, if the two index sheets are different, the processing proceeds to S26. The processing also proceeds to S26 if there is no index sheet that was fed last time.

In S26, the index sheet discharge controller 410 checks whether or not the index sheet determined in S22 is registered for the index sheet management table. If the index sheet determined in S22 corresponds to a registered index sheet, the processing proceeds to S27. Then the index sheet discharge controller 410 discharges the index sheet of the lower layer than the index sheet determined in S22, and the processing proceeds to S29. Meanwhile, if the index sheet determined in S22 is not registered in the index sheet management table, the processing proceeds to S28, and the index sheet discharge controller 410 adds the index sheet determined in S22 as a new index sheet to the index sheet management table.

In S29, the print page controller 409 feeds the index sheet determined in S22, and in 330 the index sheet discharge controller 410 adds one to the Cnt entry for the index sheet fed S29 and returns to S21.

It should be noted that the index sheet discharge in S27 is different from the index sheet in S30. S27 is a step of discharging the index sheet of a lower layer than the index sheet to be fed next, which is exactly the point of the second embodiment. Meanwhile, in S31, the index sheet discharge controller 410 discharges Num-Cnt index sheets with Num-Cnt not being zero.

As described above, the second embodiment can achieve optimal discharge of index sheets suitable for engine properties of the image forming apparatus in which multiple-layer index sheets are available.

It should be noted that the mode of the first embodiment, compared with the second embodiment, can reduce the number of times of switching index sheets at the time of index sheet discharge caused due to the multiple-layer index sheets. Such a mode is necessary for image forming apparatuses that are not good at switching sheet types.

Other Embodiments

Aspects of the present invention can also be realized by a computer of a system or apparatus for devices such as a CPU or MPU) that reads out and executes a program recorded on a memory device to perform the functions of the above-described embodiment(s), and by a method, the steps of which are Performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-091471, filed Apr. 15, 2011, which is hereby incorporated by reference herein in its entirety.

What is claimed is:

1. An image forming apparatus comprising:

a first sheet container unit configured to contain a set of first-type index sheets;

a second sheet container unit configured to contain sets of second-type index sheets;

a third sheet container unit configured to contain plain sheets;

an image forming device configured to form an image on a sheet and discharge to a first destination; and a control unit configured to:

control the image forming apparatus to feed a first-type index sheet from the first sheet container unit to the first destination;

then control the image forming apparatus to feed a second-type index sheet from the second sheet container unit to the first destination;

then control the image forming apparatus to feed a plain sheet from the third sheet container unit to the image forming device to cause the image forming device to form an image on the plain sheet fed from the third sheet container unit and discharge to the first destination;

then control the image forming apparatus to feed a next first-type index sheet from the first sheet container unit to the first destination;

control the image forming apparatus to discharge remaining second-type index sheets in a current set, among the sets of second-type index sheets, in the second sheet container unit, to a second destination after the next first-type index sheet is fed from the first sheet container unit to the first destination; and control the image forming apparatus to feed a second-type index sheet from a next set, among the sets of second-type index sheets, from the second sheet container unit to the first destination after discharging the remaining second-type index sheets in the current set.

2. The image forming apparatus according to claim 1, wherein the control unit, after a job ends, controls the image forming apparatus to discharge remaining sheets in the first sheet container unit.

3. The image forming apparatus according to claim 1, further comprising a storage unit configured to store a table for recording type, size, and number of sheets per set of sheets contained in each of the first and second sheet container units.

4. The image forming apparatus according to claim 3, wherein the table further records a flag for indicating whether or not to discharge a remaining sheet of a set of sheets contained in each of the first and second sheet container units.

5. The image forming apparatus according to claim 1, wherein the first-type index sheets are index sheets for a first layer, and the second-type index sheets are index sheets for a layer lower than the first layer.

6. The image forming apparatus according to claim 1, wherein each of the first-type index sheets is an index sheet indicating a chapter, and each of the second-type index sheets is an index sheet indicating a section.

7. The image forming apparatus according to claim 1, wherein the first-type or second-type index sheets having tabs disposed at different positions are bundled as one set.

* * * * *